US005934170A

United States Patent [19]

Morita

[11] Patent Number: 5,934,170

[45] Date of Patent: Aug. 10, 1999

[54] PISTON MECHANISM OF FLUID DISPLACEMENT APPARATUS

[75] Inventor: Yujiro Morita, Isesaki, Japan

[73] Assignee: Sanden Corporation, Isesaki, Japan

[21] Appl. No.: 08/977,615

[22] Filed: Nov. 25, 1997

[30] Foreign Application Priority Data

Nov. 25, 1996 [JP] Japan ..... 8-313865

[51] Int. Cl.[6] ..... F04B 1/12; F01B 3/00

[52] U.S. Cl. ..... 92/12.2; 92/155; 92/57; 417/269

[58] Field of Search ..... 92/12.2, 57, 71, 92/155; 417/269

[56] References Cited

U.S. PATENT DOCUMENTS

| | | | |
|---|---|---|---|
| 3,155,015 | 11/1964 | Genz | 92/249 |
| 3,418,942 | 12/1968 | Partos | 92/71 |
| 4,095,921 | 6/1978 | Hiraga et al. . | |
| 4,519,119 | 5/1985 | Nakayama et al. . | |
| 4,697,992 | 10/1987 | Hatakeyama et al. . | |
| 4,701,110 | 10/1987 | Iijima | 92/223 X |
| 4,762,468 | 8/1988 | Ikeda et al. | 92/71 X |
| 5,079,996 | 1/1992 | Abousabha et al. | 92/12.2 |
| 5,129,752 | 7/1992 | Ebbing et al. | 92/12.2 X |
| 5,169,162 | 12/1992 | Azaml et al. . | |

FOREIGN PATENT DOCUMENTS

| | | | |
|---|---|---|---|
| 0018265 | 10/1980 | European Pat. Off. . | |
| 0040911 | 2/1981 | European Pat. Off. . | |
| 0672829 | 9/1995 | European Pat. Off. . | |
| 0740076 | 10/1996 | European Pat. Off. . | |
| 503949 | 7/1937 | United Kingdom | 92/223 |

OTHER PUBLICATIONS

58081265, May 16, 1983, Mikuni Jukogyo KK, European Patent Office (Patent Abstracts of Japan).

55084880, Jun. 26, 1980, Toyoda Autom Loom Works Ltd, European Patent Office (Patent Abstracts of Japan).

European Search Report for Application No. EP 97 12 0477, Feb. 6, 1998.

*Primary Examiner*—Hoang Nguyen
*Attorney, Agent, or Firm*—Baker & Botts, LLP

[57] ABSTRACT

A piston-type fluid displacement apparatus includes several pistons, each of which is slidably disposed within one of several cylinder bores. A plating layer, which includes a self-lubricating material, is coated on a peripheral surface of each piston. At least one annular groove is formed on a periphery surface of each piston, and, at least one piston ring is disposed within the annular groove of each piston for sealing a gap between the piston and the cylinder bore. Thereby, the piston-type fluid displacement apparatus may be simply manufactured at a reduced assembly cost while simultaneously prolonging the life of the piston rings and while reducing or eliminating a decrease in compression efficiency during the operating life of the piston-type fluid displacement apparatus.

12 Claims, 2 Drawing Sheets

PISTON MECHANISM OF FLUID DISPLACEMENT APPARATUS

BACKGROUND OF THE INVENTION

1. Field of the Invention

This invention generally relates to a piston mechanism of a fluid displacement apparatus, and more particularly, to a configuration of reciprocating pistons in a refrigerant compressor for use in an automotive air conditioning system.

2. Description of Related Art

A swash plate-type compressor with a variable displacement mechanism, particularly a single head, piston-type compressor suitable for use in an automotive air conditioning system, such as that described in Japanese Patent #H2-61627, which is incorporated herein by reference.

Referring to FIG. 1, the compressor, which is generally designated by reference number 100, includes a closed cylinder housing assembly formed by annular casing 1 provided with cylinder block 2 at one of its sides; a hollow portion 1*a,* such as crank chamber; front end plate 3; and rear end plate 26.

Front end plate 3 is mounted on one end (to the left in FIG. 1) opening of annular casing 1 to close the end opening of crank chamber 1*a* and is fixed on annular casing 1 by a plurality of bolts (not shown). Rear end plate 26 and a valve plate 24 are mounted on the other end of annular casing 1 by a plurality of bolts (not shown) to cover the end portion of cylinder block 2. An opening 3*a* is formed in front end plate 3 for receiving drive shaft 4. An annular sleeve 3*b* projects from the end surface of front end plate 3 and surrounds drive shaft 4 to define a shaft seal cavity 6. A shaft seal assembly 7 is mounted on drive shaft 4 within shaft seal cavity 6.

Drive shaft 4 is rotatably supported by front end plate 3 through bearing 5, which is disposed within opening 3*a*. The inner end of drive shaft 4 is provided with a rotor plate 8. A thrust needle bearing 14 is placed between the inner end surface of front end plate 3 and the adjacent axial end surface of rotor plate 8 to receive the thrust load that acts against rotor plate 8 and to thereby ensure smooth motion. The outer end of drive shaft 4, which extends outwardly from sleeve 3*b*, is driven by the engine of a vehicle through a conventional pulley arrangement (not shown). The inner end drive shaft 4 extends into center bore 2*b,* which is formed in the center portion of cylinder block 2 and rotatably supported therein by a bearing 15, such as a radial bearing needle bearing. The axial position of drive shaft 4 may be adjusted by means of an adjusting screw 18 which engages a threaded portion of center bore 2*b*. A spring device 17 is disposed between the axial end surface of drive shaft 4 and adjusting screw 18. A thrust needle bearing 16 is placed between drive shaft 4 and spring device 17 to ensure smooth rotation of drive shaft 4.

A spherical bushing 9 placed between rotor plate 8 and the inner end of cylinder block 2 is slidably mounted on drive shaft 4. Spherical bushing 9 supports a slant or swash plate 10 for nutational, (e.g., a wobbling, bobbing or nodding up-and-down motion of a spinning body as it precesses about its axis) and rotational motion. A coil spring 12 surrounds drive shaft 4 and is positioned between the end surface of rotor plate 8 and one axial end surface of spherical bushing 9 to push spherical bushing 9 toward cylinder block 2.

Swash plate 10 is connected to rotor plate 8 by a hinge coupling mechanism for rotating in unison with rotor plate 8. In particular, rotor plate 8 may have an arm portion 8*a* projecting outward from one side surface of rotor plate 8. In such a configuration, arm portion 10*a* is formed separately from swash plate 10 and is fixed on one side surface of swash plate 10.

Arm portion 8*a* and 10*a* overlap each other and are connected to one another by a pin 11 which is received by a rectangular shaped hole 8*b* formed through arm portion 10*a* of swash plate 10. In this manner, rotor plate 8 and swash plate 10 are hinged to one another. In this configuration, pin 11 is slidably disposed in rectangular shaped hole 8*b,* and the sliding motion of pin 11 within rectangular shaped hole 8*b* alters the slant angle of the inclined surface of swash plate 10.

Cylinder block 2 has a plurality of annularly arranged cylinder bores 2*a* into which pistons 21 slide. A cylinder arrangement may include five cylinders, but a lesser or greater number of cylinders also may be provided. Each piston 21 comprises a cylindrical body 21*a* slidably disposed within annularly arranged cylinder bore 2*a* and a connecting portion 20. Connecting portion 20 of piston 21 has a cutout portion 20*b* which straddles the outer periphery portion of swash plate 10. Semi-spherical thrust bearing shoes 19 are disposed between each side surface of swash plate 10 and face semi-spherical pocket 20*a* of connecting portion 20. Thus, swash plate 10 rotates between semi-spherical thrust bearing shoes 19, moving the inclined surface axially to the right and left, thereby reciprocating each of pistons 21 within one of annularly arranged cylinder bores 2*a*. Cylinder housing 1 also may include projection portion 1*a* extending therefrom to the inside thereof and paralleled to the reciprocating direction of piston 21.

Rear end plate 26 is shaped to define a suction chamber 27 and a discharge chamber 28. Valve plate 24, which together with rear end plate 26, is fastened to the end of cylinder block 2 by bolts (not shown), is provided with a plurality of valved suction ports 22 connected between suction chamber 27 and respective annularly arranged cylinder bores 2*a,* and with a plurality of valve discharge ports 23 connected between discharge chamber 28 and respective annularly arranged cylinder bores 2*a*. Suitable reed valves for valved suction ports 22 and valved discharge ports 28 are described in U.S. Pat. No. 4,011,029, which is incorporated herein by reference. Gaskets 25 and 29 are placed between cylinder block 2 and valve plate 24, between valve plate 24 and rear end plate 26 to seal the matching surfaces of cylinder block 2, valve plate 24, and the rear end plate 26.

As shown in the lower right hand portion of FIG. 1, crank chamber 1*a* and suction chamber 27 are placed in communication via a passageway 30 which comprises an aperture 30*a* formed through valve plate 24, and gaskets 25 and 29 and a bore 32 formed in cylinder block 2. A coupling element 31 with a small aperture 31*a* is disposed in the end opening of bore 32, which faces crank chamber 1*a*. A bellows element 34 contains gas and includes a needle valve 34*a* disposed in bore 32. The opening and closing of small aperture 31*a,* which connects between crank chamber 1*a* and bore 32, is controlled by needle valve 34*a*. The axial position of bellows element 34 is determined by a frame element 33 also disposed in bore 32. At least one hole 33*a* is formed through frame element 33 to permit communication between aperture 30*a* and bore 32.

In this configuration of a swash plate-type compressor, frictional force between swash plate 10 and spherical sleeves 19 is generated because swash plate 10 slides in spherical sleeves 19 while rotating. Thus, the frictional force acts on pistons 21 to incline them forcibly in the direction of the inner surface of cylinder bores 2*a* and urging them to rotate around the axis of piston 21. Further, the inner surface of cylinder bore 2*a* prevents piston 21 from inclining a radial direction other than to rotate. Therefore, piston 21 and cylinder bore 2*a* abrade each other, and piston 21 may seize against cylinder bore 2*a*.

In an effort to resolve this problem, the outer peripheral surface of piston 21 has been coated with a plating layer containing a self lubricating material, such as a polytetrafluoroethylene resin (hereinafter "PTFE"), so that the coated plating layer reduces friction between the periphery of piston 21 and the inner surface of cylinder bore 2*a*. However, this solution requires that the outer diameter of piston 21 is designed to be about 15 $\mu$m to about 30 $\mu$m smaller than the inner diameter of cylinder bore 2*a* and that a lubricating oil is introduced between piston 21 and cylinder bore 2*a* in order to efficiently compress a refrigerant gas.

Therefore, piston 21 and cylinder bore 2*a* are manufactured to precise tolerances and are assembled to closely conform to each other. As a result, the configuration is complicated to manufacture and results in a high assembling cost.

In another approach to this problem, annular piston ring 37, which is formed of a resin, such as an engineering plastic or a PTFE resin, fits into annular groove 36 formed on the periphery surface of piston 21 to seal the periphery of piston 21 and the inner surface of cylinder bore 2*a* without coating a plating layer on the periphery surface of piston 21. Thus, piston 21 slides in cylinder bore 2*a,* such that the periphery surface of piston 21 is not in direct contact with the entire inner surface of cylinder bore 2*a*.

In this configuration, the force, which is generated by rotation of swash plate 10 via spherical sleeves 19 and inclination of pistons 21 in the radial direction, presses annular piston ring 37 to the inner surface of cylinder bore 2*a*. Consequently, annular piston ring 37 may fail if no area of cylinder bore 2*a* is adequately secured to piston ring 37 by magnifying the width of annular piston ring 37.

SUMMARY OF THE INVENTION

Therefore it is an object of the present invention to provide a piston-type fluid displacement apparatus, such as a compressor, which may be simply manufactured while simultaneously providing a piston-type fluid displacement apparatus with a prolonged piston ring life.

It is a further object of the present invention to provide a piston-type fluid displacement apparatus, such as a compressor, which achieves reduced assembly costs without loss of compression efficiency.

According to the present invention, a piston-type fluid displacement apparatus comprises a housing which encloses a crank chamber, a suction chamber, and a discharge chamber. The housing includes a cylinder block having a plurality of cylinder bores formed therein. A drive shaft that is rotatably supported in the cylinder block. Each of a plurality of pistons is slidably disposed within one cylinder bore. A plate having an angle of tilt is tiltably connected to the drive shaft. A bearing couples the plate to each of the pistons, so that each of the pistons reciprocates within one of the cylinder bores upon rotation, e.g., nutation, of the plate. A plating layer, which comprises a self-lubricating material, is coated on a periphery surface of the piston. At least one annular groove is formed on a periphery surface of the piston. At least one piston ring is disposed within the annular groove of the piston for sealing a gap between the piston and the cylinder bore.

Further objects, features, and advantages of this invention will be understood from the following detailed description of preferred embodiments with reference to the accompanying figures.

DETAILED DESCRIPTION OF PREFERRED EMBODIMENTS

Figure 1:
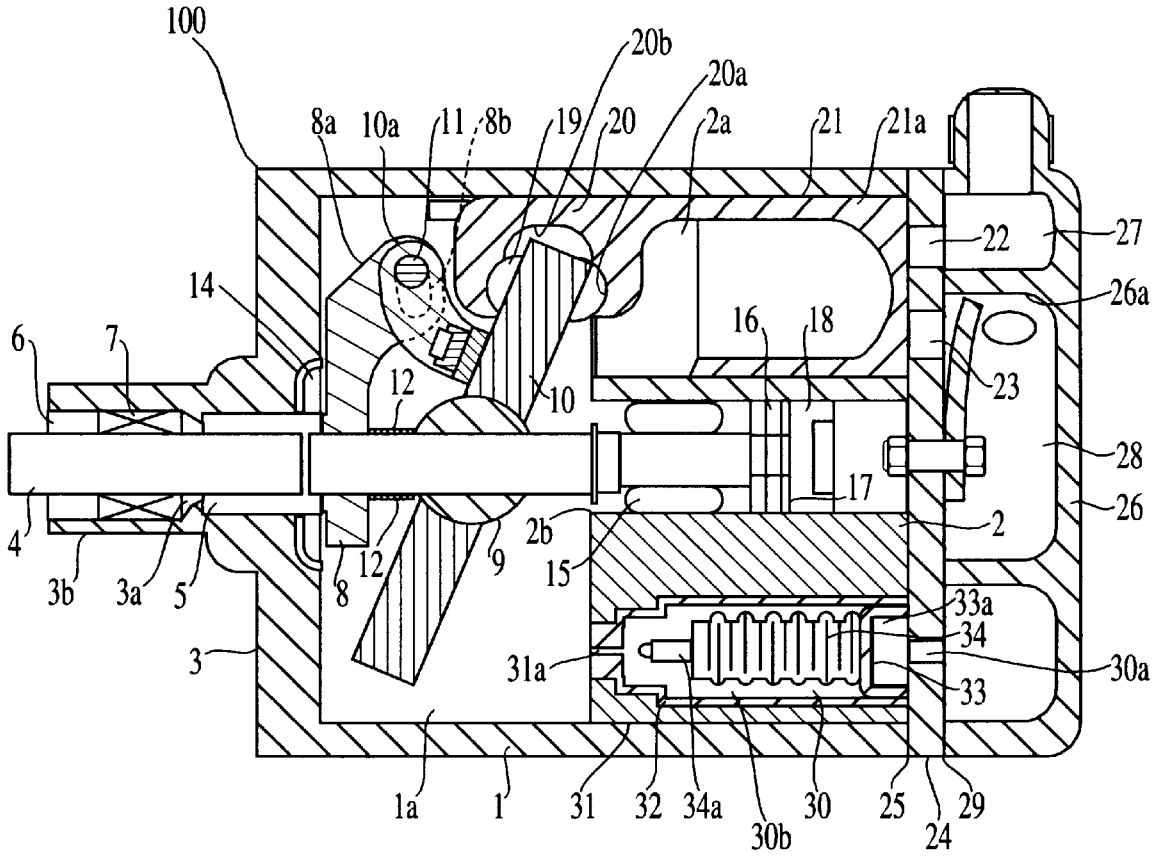
FIG. 1 PRIOR ART
FIG. 1 is a longitudinal cross-sectional view of a known swash plate-type refrigerant compressor.
Figure 2:
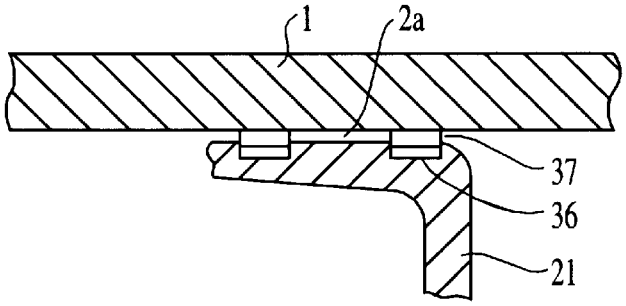
FIG. 2 PRIOR ART
FIG. 2 is an enlarged sectional view of a piston assembly for use in a known swash plate-type refrigerant compressor.
Figure 3:
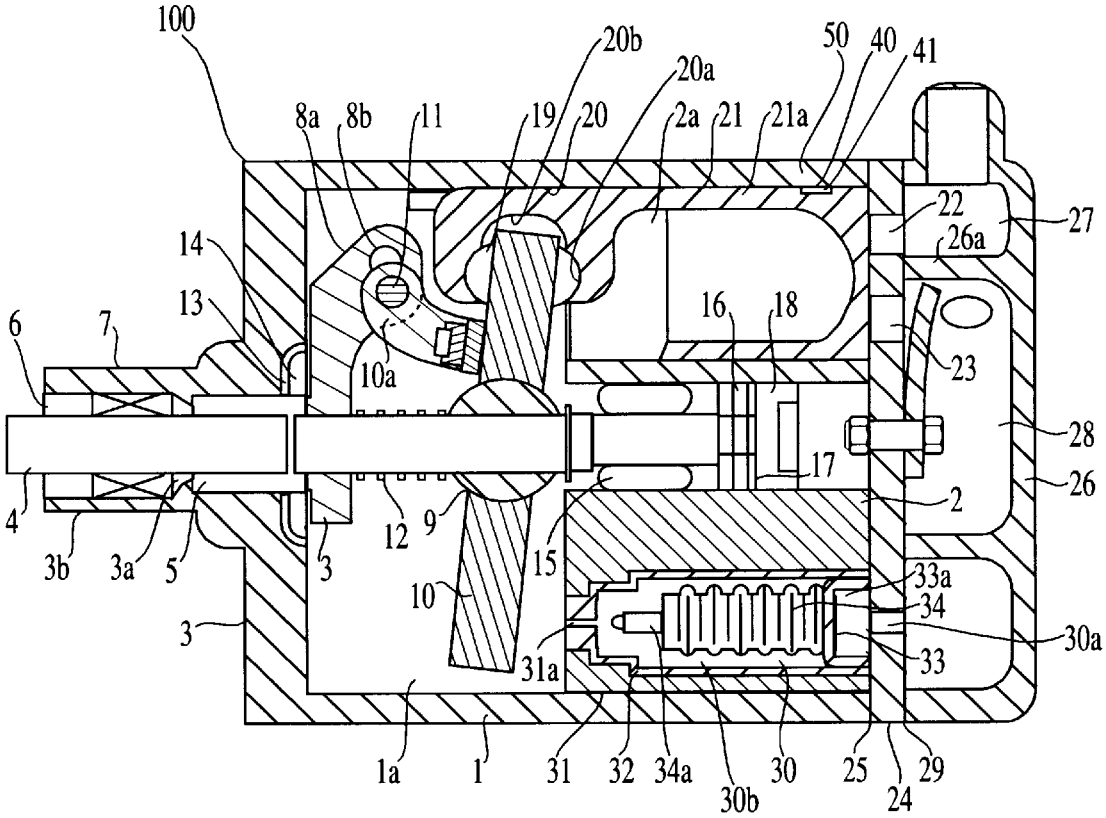
FIG. 3 is a longitudinal, cross-sectional view of a swash plate-type refrigerant compressor in accordance with an embodiment of the present invention.
Figure 4:
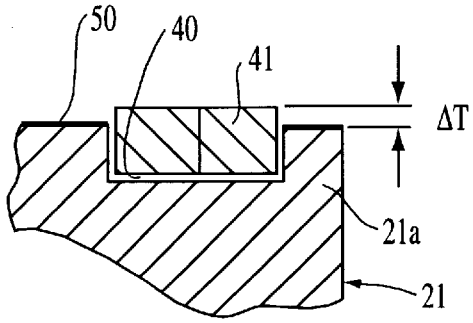
FIG. 4 is an enlarged, cross-sectional view of a piston assembly for use in a swash plate-type refrigerant compression in accordance with an embodiment of the present invention.

An embodiment of the present invention is illustrated in FIGS. 3 and 4, in which the same numerals are used to denote elements which correspond to similar elements depicted in FIG. 1 and 2. A detail explanation of several elements and characteristics of the known compressor is provided above and is, therefore, omitted from this section.

Referring to FIG. 3, piston 21 is provided with at least one annular groove 40 at its outer peripheral surface near the upper and lower portions thereof. An annular piston ring 41, which is made of a resin, preferably a PTFE resin, fits into groove 40 to seal the peripheral surface of piston 21 and the inner surface of cylinder bore 2*a*. In this embodiment, pistons 21 may be made of an aluminum alloy, and cylinder bores 2*a* also may be made of aluminum alloy or of a steel alloy. Further, the outer cylindrical surface of 21*a* of piston 21 may be coated with a plating layer 50 containing a self-lubricating material, such as PTTE resin. Annular piston ring 41 may be a closed ring or a separated ring which has a cut portion at a portion thereof If annular piston ring 41 is made of a sufficiently elastic material, it may be stretched over piston 21 and fitted within groove 40. Alternatively, annular piston ring 41 may be fitted within groove 40 by shrinkage fit.

Thus, annular groove 40 and annular piston ring 41 are formed on piston 21, so that annular piston ring 41 is contacted with the inner surface of cylinder bore 2*a*, when piston 21 stays at bottom dead center.

Referring to FIG. 4, the size relationship between piston 21, annular grove 40, and piston ring 41 is described below. Annular groove 40 has a depth defined "H." Piston ring 41 also has a radial thickness defined "T." Therefore, protrusion "ΔT" is defined as a projection in which piston ring 41 protrudes from the outer peripheral surface of piston 21.

In an embodiment of piston 21, piston ring 41 is designed to protrude slightly from the periphery surface of piston 21. In other words, thickness "T," and the inner diameter of piston ring 41, and depth "H," i.e., and the diameter of annular groove 40, measured through the axis of piston 21, are preferably designed, such that piston ring 41 protrudes radially from the periphery surface of piston 21 by thickness "ΔT" which thickness is minimal. Further, piston ring 41 may be designed so as to protrude maximally from the peripheral surface of piston 21 by protrusion "ΔT" which 40 is smaller by about 4% of thickness "T" of piston ring 41. Piston ring 41 may easily be snapped into place because of the elastic characteristics of PTFE resin when piston ring 41 is designed, so that protrusion "ΔT" is greater than about 4% of thickness "T" of piston ring 41.

In a preferred embodiment, the thickness "T" of piston ring 41 is designed to be about 1 mm. The clearance between cylinder bore 2*a* and the outer peripheral surface of piston 21 is designed to be in a range of about 15 μm to about 80 μm, For example, the outer diameter of piston 21 may be about 30 mm so that the clearance is greater than that of the conventional designs.

In operation, drive shaft 4 is rotated by an engine ( L& a vehicle engine) (not shown) through a known pulley arrangement, and rotor plate 8 is rotated together with drive shaft 4. The rotation of rotor plate 8 is transferred to swash plate 10 through the hinge coupling, so that with respect to the rotation of rotor plate 8, the inclined surface of swash plate 10 nutates and moves axially, reciprocating between the front end plate 3 direction and the rear end plate 26 direction (left and right in FIG. 3). Consequently, pistons 21, which are operatively connected to swash plate 10 by means of swash plate 10 sliding between semi-spherical thrust bearing shoes 19, reciprocate within their annularly arranged cylinder bores 2*a*. As pistons 21 reciprocate, the refrigerant gas which is introduced into suction chamber 27 from the fluid inlet port is taken into each cylinder 21 and compressed. The compressed refrigerant gas is discharged into discharge chamber 28 from each cylinder 21 through discharge port 23 and therefrom into an external fluid circuit, for example, a cooling circuit, through the fluid outlet port.

Control of displacement of the compressor may be achieved by varying the stroke of piston 21. The stroke of piston 21 varies depending on the difference between pressures which are acting on the both sides of swash plate 10, respectively. The difference is generated by balancing the pressures in crank chamber la acting on the rear surface of piston 21 with the suction pressure in cylinder bore 2*a,* which acts on the front surface of piston 21 and further on swash plate 10 through piston 21.

When the heat load of the refrigerant gas exceeds a predetermined level, the suction pressure is increased. The pressure of the gas contained in bellows element 34 may be set to be substantially the same as the pressure in a predetermined heat load level, thus, bellows element 34 is pushed towards the direction of the rear end plate 26 (the right side in FIG. 3) to open aperture 31*a*. Therefore, the pressure in crank chamber 1*a* is maintained at the suction pressure. In this condition, during the compression stroke of pistons 21, the reaction force of gas compression acts against swash plate 10 and is transferred to the hinge coupling mechanism.

Alternatively, if the heat load is decreased and the refrigerant capacity is exceeded, the pressure in suction chamber 27 is reduced, and bellows element 34 shifts in the direction of the front end plate 3 (left side in FIG. 3) to close small aperture 31*a* with needle valve 34*a*. In this case, the pressure in crank chamber la gradually increases, and a narrow pressure difference occurs because blow-by gas, which otherwise would leak from the working chamber to crank chamber 1*a* through a gap between piston 21 and cylinder bore 2*a* during the compression stroke, is contained in crank chamber 1*a*.

During a compression stroke of piston 21, the compressed refrigerant gas flows into a gap between the bottom of annular groove 40 and the inner periphery end of piston ring 41 so as to expand the diameter of piston ring 41. Therefore, piston ring 41 protrudes radially from the outer peripheral surface of piston 21 to seal the gap created between the periphery surface of piston 21 and cylinder bore 2*a*.

During a suction stroke of piston 21, piston ring 41 may only protrude by about 4% of thickness "T" of piston ring 41 from the outer peripheral surface of piston 21 because the compressed refrigerant gas does not flow into a gap between the bottom of annular groove 40 and the inner periphery end of piston ring 21. Consequently, the diameter of piston ring 41 does not expand. As a result, the frictional force is generated between swash plate 10 and spherical sleeves 19 when swash plate 10 slides in spherical sleeves 19. The frictional force acts on piston 21 to radially incline piston 21 about the longitudinal axis of piston 21 within cylinder bore 2*a* as previously described with respect to known compressors. In this embodiment, piston 21 may support this frictional force with the periphery surface of piston ring 41 and also with the periphery surface of cylindrical body 21*a* of piston 21 in these strokes of piston 21. This support may be attained because piston 21 has its periphery surface coated with a self-lubricated material and is provided with piston ring 41 different from known compressors.

Therefore, the intended clearance between cylinder bore 2*a* and piston 21 in the assembling may be greater than that of known compressors because piston 21 is provided with piston ring 41. Further, the force, wherein piston ring 41 is subjected by the above frictional force, decreases because piston 21 may be supported by the periphery surface of piston ring 41 against the frictional force described above. Moreover, piston 21 and cylinder bore 2*a* need not be produced with the same degree of precision or assembled with the same narrow tolerances. However, the life of the piston rings may still be prolonged.

Further, this arrangement of the embodiment may be simply manufactured at a reduced assembly cost while simultaneously maintaining compression efficiency.

Although the present invention has been described in connection with the preferred embodiments, the invention is not limited thereto. Specifically, while preferred embodiments illustrate the invention in a swash plate-type compressor, this invention is not restricted to swash plate-type refrigerant compressors, but may be employed in other piston-type compressors or a piston-type fluid displacement apparatus. Accordingly, the embodiments and features disclosed herein are provided by way of example only. Those of ordinary skill in the art will understand that variations and modifications may be made within the scope of this invention as defined by the following claims.

What is claimed is:

1. A piston-type fluid displacement apparatus comprising:

a housing enclosing a crank chamber, a suction chamber, and a discharge chamber, said housing including a cylinder block, wherein a plurality of cylinder bores formed in said cylinder block;

a drive shaft rotatably supported in said cylinder block;

a plurality of pistons, each of which is slidably disposed within one of said cylinder bores;

a plate having an angle of tilt and tiltably connected to said drive shaft;

a plurality of bearings coupling said plate to each of said pistons so that said pistons reciprocates within said cylinder bores upon rotation of said plate;

a plating layer, comprising a self-lubricating material, is coated on a peripheral surface of said piston;

at least one annular groove formed on a periphery surface of said piston; and at least one piston ring disposed within said annular groove of said piston for sealing a gap between said piston and said cylinder bore, wherein said annular groove and said piston ring have respectively a depth and a thickness, so that said annular ring protrudes from the peripheral surface of said piston and wherein said annular groove and said piston ring have respectively a depth and a thickness so that said annular ring protrudes from the peripheral surface of said piston by less than about 4% of a radial thickness of said annular ring.

2. The apparatus of claim 1, wherein said lubricating material is a polytetrafluoroethylene resin.

3. The apparatus of claim 1, wherein said piston ring is made of an engineering plastic.

4. The apparatus of claim 3, wherein said engineering plastic is a polytetrafluoroethylene resin.

5. The apparatus of claim 1, wherein said piston ring is a closed ring.

6. The apparatus of claim 1, wherein said piston ring is a separated ring having a cut portion at a portion thereof.

7. A swash plate-type refrigerant compressor comprising:

a housing enclosing a crank chamber, a suction chamber, and a discharge chamber, said housing including a cylinder block, wherein a plurality of cylinder bores formed in said cylinder block;

a drive shaft rotatably supported in said cylinder block;

a plurality of pistons, each of which is slidably disposed within one of said cylinder bores; each of said pistons having a cylindrical body and an engaging portion axially extending from a first axial end of said cylindrical body;

a plate having an angle of tilt and tiltably connected to said drive shaft;

a plurality of bearings coupling said plate to each of said pistons so that said pistons reciprocates within said cylinder bores upon rotation of said plate;

a plating layer, comprising a self-lubricating material, coated on a peripheral surface of said piston;

at least one annular groove formed on a periphery surface of said piston; and at least one piston ring disposed within said annular groove of said piston for sealing a gap between said piston and said cylinder bore, wherein said annular groove and said piston ring have respectively a depth and a thickness, so that said annular ring protrudes from the peripheral surface of said piston and wherein said annular groove and said piston ring have respectively a depth and a thickness, so that said annular ring protrudes from the peripheral surface of said piston by less than about 4% of a radial thickness of said annular ring.

8. The compressor claim 7, wherein said self-lubricating material is a polytetrafluoroethylene resin.

9. The compressor of claim 7, wherein said piston ring is made of an engineering plastic.

10. The compressor of claim 9, wherein said engineering plastic is a polytetrafluoroethylene resin.

11. The compressor of claim 7, wherein said piston ring is a closed ring.

12. The compressor of claim 7, wherein said piston ring is a separated ring having a cut portion at a portion thereof.

* * * * *